US008858397B2

(12) United States Patent
Ishii et al.

(10) Patent No.: US 8,858,397 B2
(45) Date of Patent: Oct. 14, 2014

(54) TRAINING DEVICE AND A CONTROL METHOD OF THE SAME

(75) Inventors: Hiroshi Ishii, Kashiwa (JP); Kouichi Ohno, Tokyo (JP); Hiroshi Yaegashi, Chiba (JP); Kazuo Yuge, Narashino (JP); Masahiro Katou, Asaka (JP); Yukihide Iwamoto, Fukuoka (JP); Makoto Hashizume, Fukuoka (JP); Hajime Kenmotsu, Fukuoka (JP); Shinichiro Takasugi, Fukuoka (JP)

(73) Assignees: Hitachi, Ltd., Tokyo (JP); Hitachi Keiyo Engineering & Systems, Ltd., Chiba (JP)

( * ) Notice: Subject to any disclaimer, the term of this patent is extended or adjusted under 35 U.S.C. 154(b) by 691 days.

(21) Appl. No.: 12/921,631

(22) PCT Filed: Mar. 19, 2009

(86) PCT No.: PCT/JP2009/055463

§ 371 (c)(1),
(2), (4) Date: Dec. 23, 2010

(87) PCT Pub. No.: WO2009/116631

PCT Pub. Date: Sep. 24, 2009

(65) Prior Publication Data

US 2011/0082006 A1 Apr. 7, 2011

(30) Foreign Application Priority Data

Mar. 19, 2008 (JP) ..... 2008-072084

(51) Int. Cl.
*A63B 21/005* (2006.01)
*A63B 24/00* (2006.01)

(Continued)

(52) U.S. Cl.
CPC ..... *A63B 23/0405* (2013.01); *A63B 24/0087* (2013.01); *A63B 21/0058* (2013.01); *A63B 2220/40* (2013.01); *A63B 2220/13* (2013.01);

(Continued)

(58) Field of Classification Search
CPC ..... A63B 21/0058; A63B 2220/54; A63B 21/00181; A63B 24/00; A63B 2024/0093; A63B 21/002; A63B 2220/51
USPC ..... 482/1, 2, 4, 5, 6, 7, 8
See application file for complete search history.

(56) References Cited

U.S. PATENT DOCUMENTS 4,934,694 A * 6/1990 McIntosh ..... 482/9
5,186,695 A * 2/1993 Mangseth et al. ..... 482/6

(Continued)

FOREIGN PATENT DOCUMENTS

JP 61-25576 2/1986
JP H03-39062 U 4/1991

(Continued)

OTHER PUBLICATIONS

Office Action issued on Jun. 28, 2012, in corresponding Korean Patent Application No. 10-2010-7020048.

(Continued)

*Primary Examiner* — Loan H Thanh
*Assistant Examiner* — Sundhara Ganesan
(74) *Attorney, Agent, or Firm* — Antonelli, Terry, Stout & Kraus, LLP

(57) ABSTRACT

A training machine for enabling the exerciser to exercise under a load appropriate for the individual exercise capability and physical function of the exerciser. The exerciser (E) enters a desired velocity-load characteristic into a load characteristic input device (7), and the velocity-load characteristic is stored in the load characteristic memory device (8). A load instruction value is determined according to the velocity-load characteristic and to the velocity inputted from a velocity calculation means (6) into the load characteristic memory device (8) and transmitted to a control means (1). The control means (1) rotates a servomotor (2) with a torque instruction value corresponding to the load instruction value. A movement mechanism (3) converts the rotation into linear movement to move a movable unit (4). With this, the exerciser can carry out training of reciprocal movement.

14 Claims, 10 Drawing Sheets

(51) Int. Cl.

| | |
|---|---|
| ***A63B 21/00*** | (2006.01) |
| ***A63B 23/035*** | (2006.01) |
| ***A63B 23/04*** | (2006.01) |
| *A63B 21/002* | (2006.01) |

(52) U.S. Cl.

CPC . *A63B 2208/0238* (2013.01); *A63B 2021/0026* (2013.01); *A63B 21/1488* (2013.01); *A63B 21/002* (2013.01); *A63B 2220/30* (2013.01); *A63B 21/00069* (2013.01); *A63B 23/03525* (2013.01)

USPC ..... 482/6; 482/5; 482/7

(56) References Cited

U.S. PATENT DOCUMENTS

| | | | | | |
|---|---|---|---|---|---|
| 5,314,390 | A | * | 5/1994 | Westing et al. | 482/6 |
| 5,407,403 | A | * | 4/1995 | Coleman | 482/6 |
| 5,697,869 | A | * | 12/1997 | Ehrenfried et al. | 482/6 |
| 5,738,611 | A | * | 4/1998 | Ehrenfried et al. | 482/6 |
| 5,762,584 | A | * | 6/1998 | Daniels | 482/5 |
| 5,919,115 | A | * | 7/1999 | Horowitz et al. | 482/6 |
| 5,993,356 | A | * | 11/1999 | Houston et al. | 482/4 |
| 7,641,597 | B2 | * | 1/2010 | Schmidt | 482/51 |
| 7,682,287 | B1 | * | 3/2010 | Hsieh | 482/5 |
| 2009/0156362 | A1 | * | 6/2009 | Berg | 482/2 |

FOREIGN PATENT DOCUMENTS

| | | |
|---|---|---|
| JP | 03-136672 | 6/1991 |
| JP | 07-250916 | 10/1995 |
| JP | 08-500985 | 2/1996 |
| JP | 2001-204850 | 7/2001 |
| JP | 2002-17887 | 1/2002 |
| JP | 2003-314437 | 11/2003 |
| JP | 2005-230327 | 9/2005 |
| JP | 2005-296672 | 10/2005 |
| JP | 2007-296070 | 11/2007 |
| JP | 2008-036054 | 2/2008 |
| JP | 2008-044409 | 2/2008 |

OTHER PUBLICATIONS

JP Office Action for Japanese Application No. 2008-072084, issued on Apr. 2, 2013.

* cited by examiner

FIG.3
FIG.3A
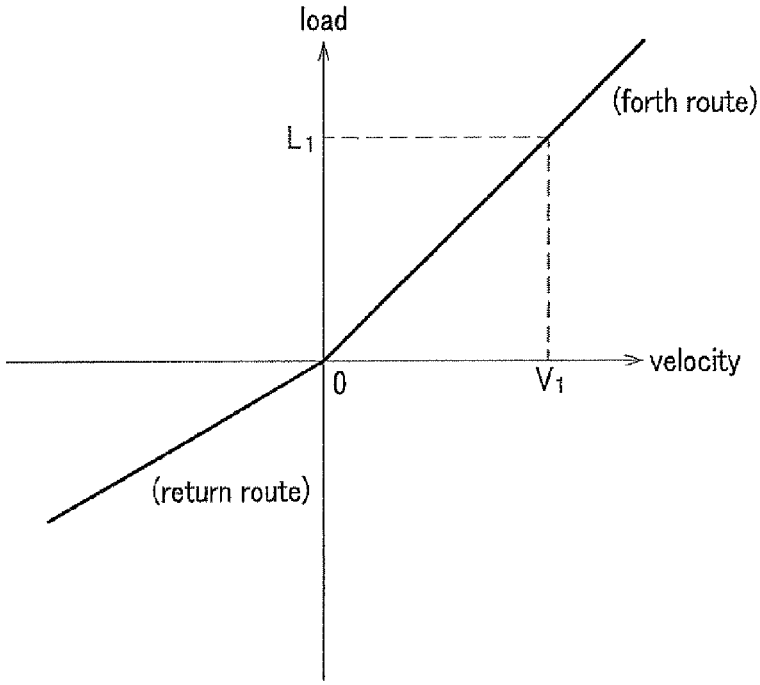
FIG.3B
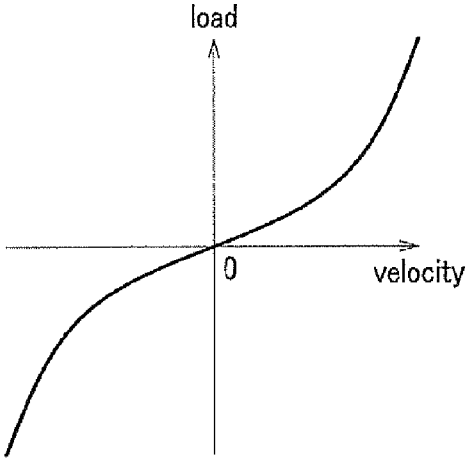
FIG.3C
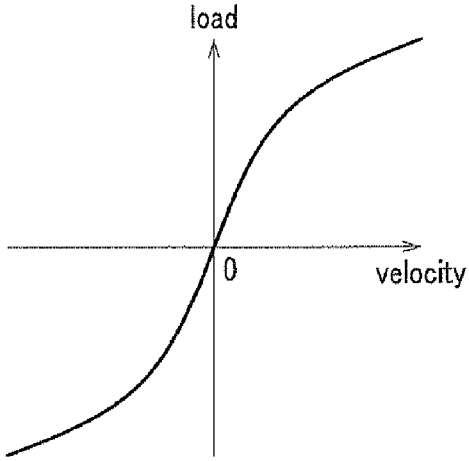

TRAINING DEVICE AND A CONTROL METHOD OF THE SAME

TECHNICAL FIELD

The present invention relates to a training device etc. for a muscular workout of an exerciser. In particular, it relates to the training device and a control method of the training device for applying load to the exerciser by a rotary torque of an electric motor.

BACKGROUND ART

In recent years, exercisers are increasing in number with use of the training device in a fitness gym or the like with a health-oriented trend. As a governmental policy, from a viewpoint of care prevention of aged person in order not to be a man requiring caregivers or the like, aged person are increasing in number doing the muscular workout for maintenance in healthy condition or prevention of reduction in physical strength. As such a training device, there are, for example, a leg press machine for strengthening leg muscles or a chest press machine for strengthening chest and arm muscles. As a training device for such a use, a plate weight method applying load to an exerciser with use of a plate weight is principally available. It is, however, hard to perform a fine control of load by this plate weight method. Then, it is hard to do an appropriate muscular workout for each exerciser. Therefore, the training device driven by motor applying load to an exerciser by a torque of the electric motor in recent years is gradually spreading. The training device driven by motor can perform a fine control of load by controlling a torque of the electric motor. As a result, an exerciser can do the muscular workout safely, happily, and effectively.

As the training device driven by motor, for example, the training device being variable in load has been disclosed by detecting a relative movement position of a plate positioned at a tip of leg of leg press machine. In this technology, load of the electric motor is controlled by a load characteristic to be a predetermined position as pre-programmed by detecting a relative movement position between the exerciser and a press board at the time of leg press in the training device. This enables it to make the largest initial load at an initial condition of the leg press, and to make the smallest final load at a final condition thereof together with a relative movement of the press board. Then, the exerciser can do an appropriate muscular workout.

The training device being variable in load has been also disclosed by detecting a relative movement velocity of the press board of leg press machine (for example, Japanese patent unexamined laid-open publication No. 204850 of 2001). In this technology, load of the electric motor is variably controlled in accordance with a change of the relative movement velocity by detecting a relative movement velocity of the press board at the time of leg press in the training device. Then, load can be gradually reduced in case where a relative movement of the press board becomes slow at the time of leg press. As a result, load can be reduced according to a degree of fatigue of the exerciser. Then, the promotion of continuation of the muscular workout and an achievement of target momentum to the exerciser can be obtained.

A muscle can be exerted only in a direction to be contracted. However, there are two kinds of exercises, that is, a concentric exercise and an eccentric exercise as the muscular workout. The concentric exercise is an exercise, exerting a force while the muscle contracts. For example, the leg press movement is an exercise stretching a knee while the press board is pressed. For example, the leg press exercise is an exercise doing in a direction bending the knee while the press board is pressed. Then, the muscle is exerted a force in a direction to be contracted while a quadriceps is stretched. The eccentric exercise is an exercise exerting a force while the muscle is stretched. For example, the leg press exercise is an exercise exerting a force in a direction bending the knee while the press board is pushed. Then, the muscle is exerted a force in a direction to be contracted while the quadriceps are stretched.

In general, it is said that the eccentric exercise is more effective in strength of muscle than the concentric exercise. The reason is that the eccentric exercise is larger in damage of muscle fiber caused by exercises than the concentric exercise. A muscular hypertrophy of the eccentric exercise can be easily obtained by damage repair process, compared with the concentric exercise.

However, the eccentric exercise is an exercise having a high frequency of tardive muscle pains. It is said that the concentric exercise is appropriate for aged person, patients doing rehabilitation, or injured person rather than a professional athlete. The concentric exercise is more preferable than the eccentric exercise as training for maintenance in healthy condition and prevention of reduction in physical strength. For example, in case of a training done by a device such as conventional leg press machine, it is designed to push the press board in case of stretching a knee (doing a leg press exercise) and to pull the press board in case of bending a knee (an exercise applying force in a reverse direction with such a leg press exercise is referred to as a full concentric exercise in this specification). Accordingly, it is preferable that either case of reciprocal motion of a tip of leg falls into the concentric exercise (doing the concentric exercise in both of the reciprocating and bidirectional directions is referred to as a full concentric exercise). In this case, it falls into a concentric exercise done by hamstrings in case of bending a knee. In addition, the full concentric exercise cannot be obtained in the training device of plate weight method. However, the full concentric exercise can be obtained by changing a direction of load by changing a direction of exercise of the press board in the training device driven by motor.

DISCLOSURE OF INVENTION

However, a technology disclosed in Japanese patent unexamined laid-open publication No 204850 of 2001 is designed to change load applied to an exerciser by a relative exercise position of the press board at the time of leg press in the training device. Accordingly, it has a problem, in which an appropriate load cannot be applied to an exerciser, when sitting place or posture of an exerciser deviate somewhat from a prescribed position. For example, one example is a case where sitting place or posture of an exerciser each day deviate from the prescribed place or posture, or the other example is a case where sitting place or posture of an exerciser during exercising deviates from the prescribed place or posture.

A technology disclosed in Japanese patent unexamined laid-open publication No. 296672 of 2005 is designed to vary in load by a relative exercise velocity of the press board. Then, it has a problem to fail in obtaining a full concentric exercise applying load bidirectionally although load reduces according to a degree of fatigue of an exerciser.

The present invention has been, therefore, made considering the above problem. It is an object to provide a training device and a control method thereof to exercise safely and effectively under the load suitable for exercise capacity or physical function of each exerciser.

Means for Solving the Above Problem

To solve the above problem, the present invention is a training device doing muscular workout to apply load to an exerciser by rotary torque of an electric motor. Furthermore, it is characterized by including a detection means seeking for velocity or acceleration of exercise in the muscular workout, a load characteristic input device for inputting a velocity-load characteristic being load characteristic to the velocity or an acceleration-load characteristic being load characteristic to the acceleration, a load characteristic memory device for memorizing the velocity-load characteristic or the acceleration-load characteristic, and a control means for calculating a torque instruction value based on the velocity-load characteristic or the acceleration-load characteristic memorized in the load characteristic memory device and controlling the rotary torque of the electric motor in accordance with the torque instruction value.

Effect of the Invention

According to the present invention, it can provide a training device and a control method of the training device to exercise safely and effectively under the load suitable for exercise capacity or physical function of each exerciser.

BRIEF DESCRIPTION OF DRAWINGS

FIG. 3A is a view of velocity-load characteristic inputted into the training device in FIG. 2, and FIGS. 3B and 3C are views of alteration example of the velocity-load characteristic.

FIG. 10 shows a leg press exercise during a forth route and FIG. 10 shows a lift-off exercise during a return route.

BEST MODE FOR CARRYING OUT THE INVENTION

Hereinafter, the training device according to each embodiment of the present invention will be described with reference to drawings.

A First Embodiment

Figure 1:
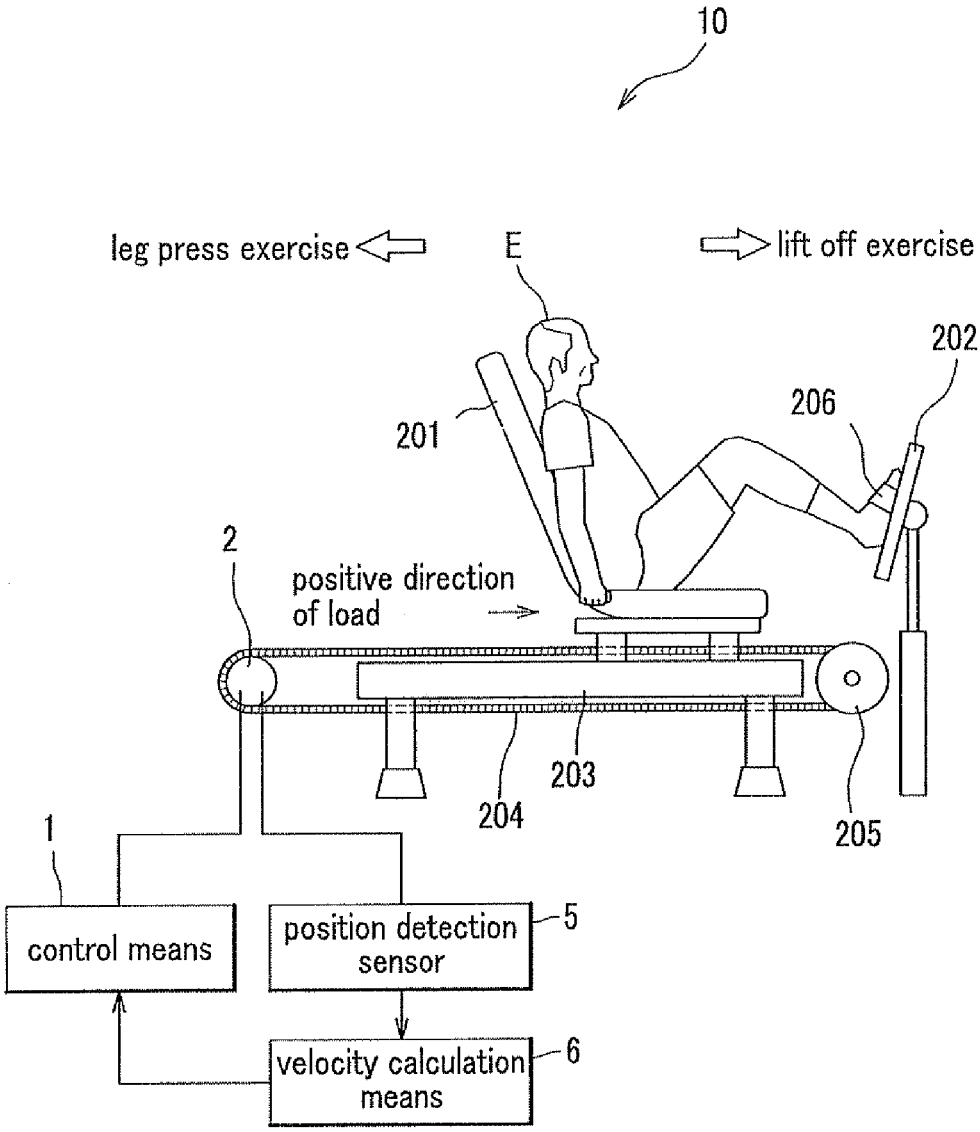
FIG. 1 is a view showing a constitution of the training device according to each embodiment of the present invention.

At first, a constitution of the training device will be described for readily understanding thereof. FIG. 1 is a constitution of the training device according to each embodiment of the present invention. As shown in FIG. 1, the training device 10 includes a control means 1, a servomotor 2, a position detection sensor 5, a velocity calculation means 6, a chair 201, a press board 202, a rail 203, a belt 204, a pulley 205, and a fixed member 206.

The control means 1 is a means for generating driving current of the servomotor 2 in accordance with velocity data (rotary velocity of the servomotor 2 or linear moving velocity of the belt 204) received from the velocity calculation means 6. The servomotor 2 is designed to rotate by driving current generated by the control means 1, generate rotary torque corresponding to a magnitude of driving current, and give linear driving power transmitted through the belt 204.

The chair 201 is a means for sitting down during the training of an exerciser. This is designed to secure a part of the lower member to a part of the belt 204. This chair 201 is designed to move the belt 204 and slide in a left and right direction in figure on the rail 203. The press board 202 is a means for pushing with tips of feet of the exerciser fixed by the fixed member 206. The belt 204 is wounded around the servomotor 2 and the pulley 205. This is a means for converting rotary torque of the servomotor 2 into linear driving power.

Next, actions of the training device shown in FIG. 1 will be described. When an exerciser E sitting down on the chair 201 pushes the press board 202 with one's tips of legs, the exerciser moves to a left direction in figure together with the chair 201 against the linear driving power transmitted from the rotary torque of the servomotor 2 to the belt 204 (that is, doing the leg press exercise). In case where the exerciser put a force in the leg to bend knees, the exerciser moves to a right direction in figure together with the chair 201 (that is, doing the lift off exercise), as one's tips of legs are secured to the press board 202 by the fixed member 206. A training program relates to bidirectional exercises of a leg press exercise and a lift off exercise. The other type of exercise programs can be, however, obtained. A direction of the servomotor 2 rotating in a clockwise direction, in other words, a direction of load applied at the time of doing leg press exercise is designated as a positive direction (an orthodromic direction) of load.

On the other hand, the servomotor 2 generates rotary torque according to a magnitude of driving current based on velocity data received from the control means 1. It makes the exerciser to move in a linear direction through the belt 204, as the driving power transmitted, together with the chair 201. Thus, the servomotor 2 applies load through the press board 202 to legs of the exerciser. Then, the position detection sensor 5 detects a linear moving position of the belt 204 or a rotary position of the servomotor 2. Then, the velocity calculation means 6 calculates a velocity by time differentiating a moving distance in a prescribed period. Then, the velocity data is transmitted to the control means 1. As a result, the control means 1 is designed to generate a driving current corresponding to the velocity data and rotate the servomotor 2.

Figure 2:
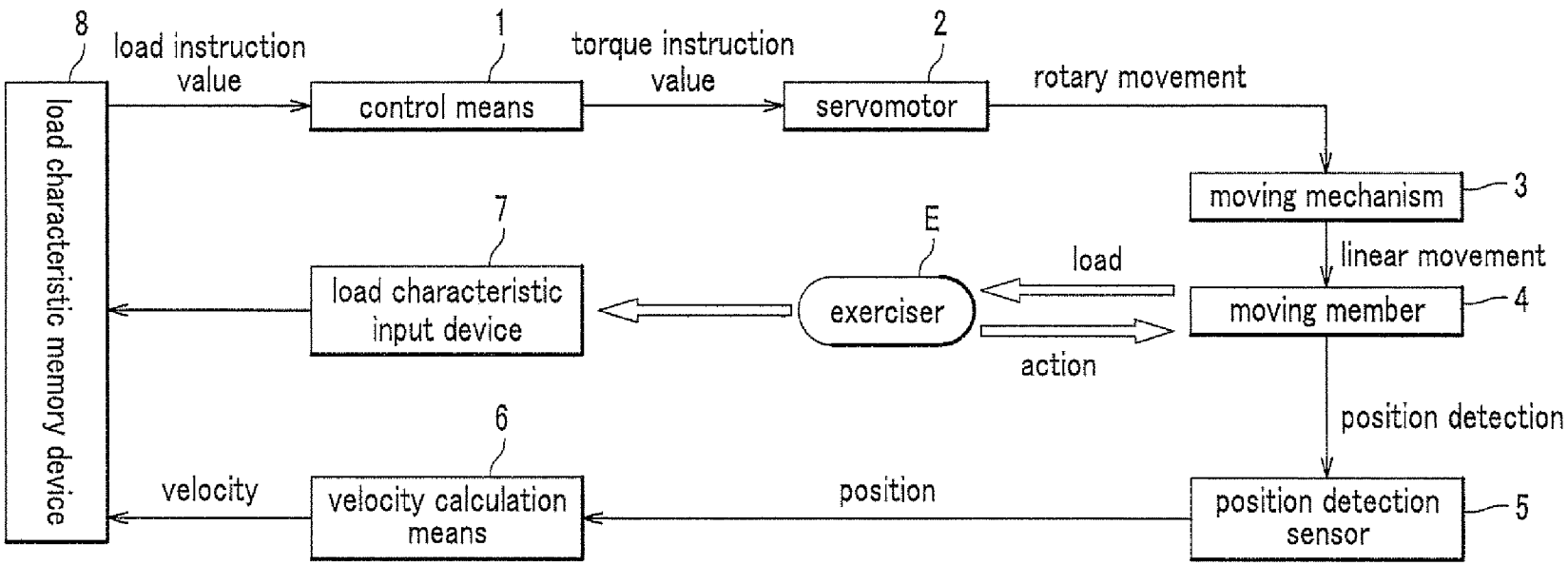
FIG. 2 is a view showing a system configuration of the training device according to a first embodiment of the present invention.

FIG. 2 is a view showing a system configuration of the training device according to a first embodiment of the present invention. This system configuration shows a control block diagram for controlling load of the servomotor 2 affecting an exerciser E. FIG. 3A is a view of the velocity-load characteristic inputted in the training device in FIG. 2. The horizontal axis in figure represents a velocity, and the vertical axis in figure represents a load. This velocity-load characteristic shows a load characteristic depending on velocity, which changes a magnitude of load according to the velocity.

The velocity is a rotary velocity of the servomotor 2 or a linear moving velocity of the belt 204 as shown in FIG. 1. The load is a load of the press board 202 affecting the exerciser E shown in FIG. 1. In case where the velocity-load characteristic is shown as a characteristic line on an coordinate with the velocity and the load respectively having as each axis thereof, the characteristic line passes through a zero point of the coordinate axis, directions of load are completely reverse between the positive case and the negative case of the velocity, and it is continuous (differentiable) line around a zero point. This line is a line (a straight line, a curve, or these combinations). Or, an exerciser can do a full concentric exercise smoothly without receiving a strong impact at the time of changing a moving direction by setting a slightly discontinuous line around a zero point as a load characteristic. A gradient of the characteristic line is designated to change large at front and rear positions of a zero point. A value of characteristic line is designated to be slightly discontinuous at front and rear positions of a zero point. In these cases, it may be designed that an exerciser E feels like having some changes or impacts. That is, the characteristic line may be changed according to an aim or a use of exercises. FIGS. 3B and 3C are views showing modifications of the velocity-load characteristic.

A system configuration of the training device shown in FIG. 2 will be described with reference to FIG. 1 and FIG. 3A.

A system of this training device is constituted to include a control means 1, a servomotor 2, a movement mechanism 3, a movable member 4, a position detection sensor 5, a velocity calculation means 6, a load characteristic input device 7, and a load characteristic memory device 8. The control means 1, the velocity calculation means 6, the load characteristic input device 7, and the load characteristic memory device 8 can be realized by a part or a whole of a computer device constituted by a CPU (Central Processing Unit), a RAM (Random Access Memory), a ROM (Read Only Memory), a HDD (Hard Disk Drive), an input means (keyboard, mouse, etc), an output means (display, speaker, etc), a communication interface or the like.

The control means generates the driving current on the basis of the load instruction value showing the velocity-load characteristic in FIG. 3A, and is a means for supplying the servomotor 2 with this driving current as a torque instruction value.

The servomotor (electric motor) 2 is a means for generating the rotary torque corresponding to the torque instruction value (driving current). The movement mechanism 3 is a means for converting a rotary movement of the servomotor 2 into a linear movement. This mechanism is equivalent to the belt 204 and the pulley 205 of the training device 10 shown in FIG. 1.

The movable member 4 is a medium for applying load and affecting action to an exerciser E through the press board 202 (Referring to FIG. 1) by the movement mechanism 3 (belt 4). The rail 203 and the chair 201 of the training device 10 shown in FIG. 1 is equivalent to the movable member 4. The position detection sensor 5 is a means for detecting a rotary position of the servomotor 2 and a linear moving position of the movement mechanism 3. The velocity calculation means 6 is a means for calculating the velocity by time differentiating a moving distance at a position detected by the position detection sensor 5. The detection means described in claim 1 is realized by the position detection sensor 5 and the velocity calculation means 6.

The load characteristic input device 7 is a means for inputting the velocity-load characteristic shown in FIG. 3A by an exerciser E. As for this velocity-load characteristic, a slope of load to the velocity in the forth route (a direction of leg press exercise of the exerciser E moving to a right direction in FIG. 1) is different from a slope of load to the velocity in the return route (a direction of lift off exercise of the exerciser E moving to a left direction in FIG. 1) as shown in FIG. 3A. However, the slope can be voluntarily varied by the exercise capacity or the like of the exerciser E. The slopes of forth and return routes may be the same according to its necessity.

The velocity-load characteristic shows a direction of leg press exercise of load going toward the exerciser E in a first quadrant of FIG. 3A. The velocity-load characteristic shows a direction of lift off exercise leaving from the exerciser E in a third quadrant of FIG. 3A. The velocity-load characteristic inputted from the load characteristic input device may be a linear characteristic of linear function of velocity, and may be non-linear characteristic of n-th order function of velocity shown in FIGS. 3B and 3C according to the exercise capacity of the exerciser E. That is, the velocity-load characteristic may be the load characteristic such as first, second, third, and half power of velocity.

The load characteristic memory device 8 is designed to memorize the velocity-load characteristic shown in FIG. 3A inputted by the exerciser E from the load characteristic input device in a memory in the form of function, map, table, etc. A magnitude of load to the velocity inputted from the velocity calculation means 6 is inputted in the control means 1 as the load instruction value in accordance with the velocity-load characteristic.

In FIG. 2, the load characteristic (velocity-load characteristic) to the velocity shown in FIG. 3A is inputted from the load characteristic input device 7. In this case, the velocity-load characteristic is memorized in the load characteristic memory device. Thus, when the exerciser E does the training affecting action against the load, the position detection sensor 5 detects the moving position of the movable member 4 by the leg press exercise and the lift off exercise. The velocity calculation means 6 calculates the velocity by time differentiating the moving distance of the position detected by the movable member 4. This velocity is inputted in the load characteristic memory device 8.

As a result, with reference to the velocity-load characteristic inputted beforehand from the exerciser E and memorized in the load characteristic memory device 8, a value of the load corresponding to the velocity inputted from the velocity calculation means 6 is inputted in the control means 1 as the load instruction value. For example, when the velocity V1 is inputted from the velocity calculation means 6 to the load characteristic memory device 8, a value of the load L1 is inputted in the control means 1 as the load instruction value in accordance with the velocity-load characteristic memorized beforehand in the load characteristic memory device 8.

Accordingly, the control means 1 supplies the servomotor 2 with the torque instruction value (driving current) corresponding to the load instruction value (load L1). Thus, the servomotor 2 generates the rotary torque corresponding to the load L1 inputted as the load instruction value to transmit to the movement mechanism 3 (belt 204 in FIG. 1). The movement mechanism 3 moves the movable member 4 (belt 204 and the chair 201 in FIG. 1) along the rail 203 by the linear movement equivalent to the load L1.

In this way, an exerciser E sitting on the chair 201 can do the muscular workout of legs against the load L1 applied to the press board 202 by the kinetic energy converted from the rotary movement of the servomotor 2 to the linear movement of the movable member 4.

When the movable member 4 moves by such muscular workout, a position (moving distance), which the movable member 4 moves, is detected by the position detection sensor 5. The velocity calculation means 6 calculates the velocity by time differentiating the moving distance of the movable member 4, and the velocity is inputted in the load characteristic memory device 8. Furthermore, the load characteristic memory device 8 seeks for a magnitude of the load corresponding to the velocity in accordance with the velocity-load characteristic, the servomotor 2 rotates by inputting a magnitude of the load as a load instruction value in the control means 1. In such a way, the exerciser E does the leg press exercise of return route in accordance with the velocity-load characteristic inputted in the load characteristic memory device 8.

As for return route, when the load corresponding to the velocity is applied from the press board 202 to the leg of the exerciser E in accordance with the velocity-load characteristic shown in a third quadrant in FIG. 3A, the exerciser E does the lift off exercise by the action corresponding to the load in a direction, in which the press board 202 leaves. In this way, the full concentric exercise can be performed in the training device of the first embodiment shown in FIG. 2.

In addition, an appropriate full concentric exercise can be obtained by the leg press exercise and the lift off exercise suitable for each exerciser, by which a slope of the load at the velocity-load characteristic changes voluntarily in forth and return routes. The slope of forth and return routes may be the same, and the velocity-load characteristic may be either a linear characteristic or a non-linear characteristic according to the exercise capacity of exercisers.

In the training device of the first embodiment shown in FIG. 1, in case where the exerciser E inputs the load characteristic (velocity-load characteristic) to the velocity in the load characteristic input device 7, the velocity-load characteristic is memorized in the load characteristic memory device 8. The control means 1 controls the rotary torque of the servomotor 2 according to the velocity-load characteristic memorized in the load characteristic memory device 8, and apply the load to the exerciser E by converting the rotary torque into the linear driving power by the movement mechanism 3 and the movable member 4. Then, the concentric exercise for the exerciser E can be obtained. The position of the movable member 4 is detected by the position detection sensor 5, the velocity is calculated by time differentiating with use of the velocity calculation means 6, and the velocity data is inputted in the load characteristic memory device 8. Then, an appropriate full concentric exercise for the exerciser E can be obtained according to the load characteristic to the velocity. As the load is applied to the exerciser E in accordance with the load characteristic as shown in FIG. 3, an initial load is small and a gentle exercise for exercisers such as aged person can be obtained.

The acceleration calculation means can be used in place of the velocity calculation means 6. In this case, the acceleration calculation means is designed to calculate the acceleration by differentiating twice the moving distance of the position detected by the position detection sensor 5 and input in the load characteristic memory device 8. Then, the acceleration-load characteristic is memorized in the load characteristic memory device 8 in place of the velocity-load characteristic as shown in FIG. 3A. Thus, the control means 1 applies the torque instruction value to the servomotor 2 in accordance with the load instruction value according to the acceleration-load characteristic. Compared with the velocity-load characteristic, the acceleration-load characteristic may be, for example, a characteristic, in which the vertical axis is load and the horizontal axis is acceleration (slope of velocity (rate of change)).

In the leg press exercise of the forth route and the lift off exercise of the return route, as a rotary direction of the servomotor 2 turns in a reverse direction, the servomotor 2 becomes a power generator and electric energy at the time of reversing is regenerated. This electric energy is charged in the charging device as not shown and the display etc. of the training device is driven by this electric energy according to its necessity.

Second Embodiment

Figure 4:
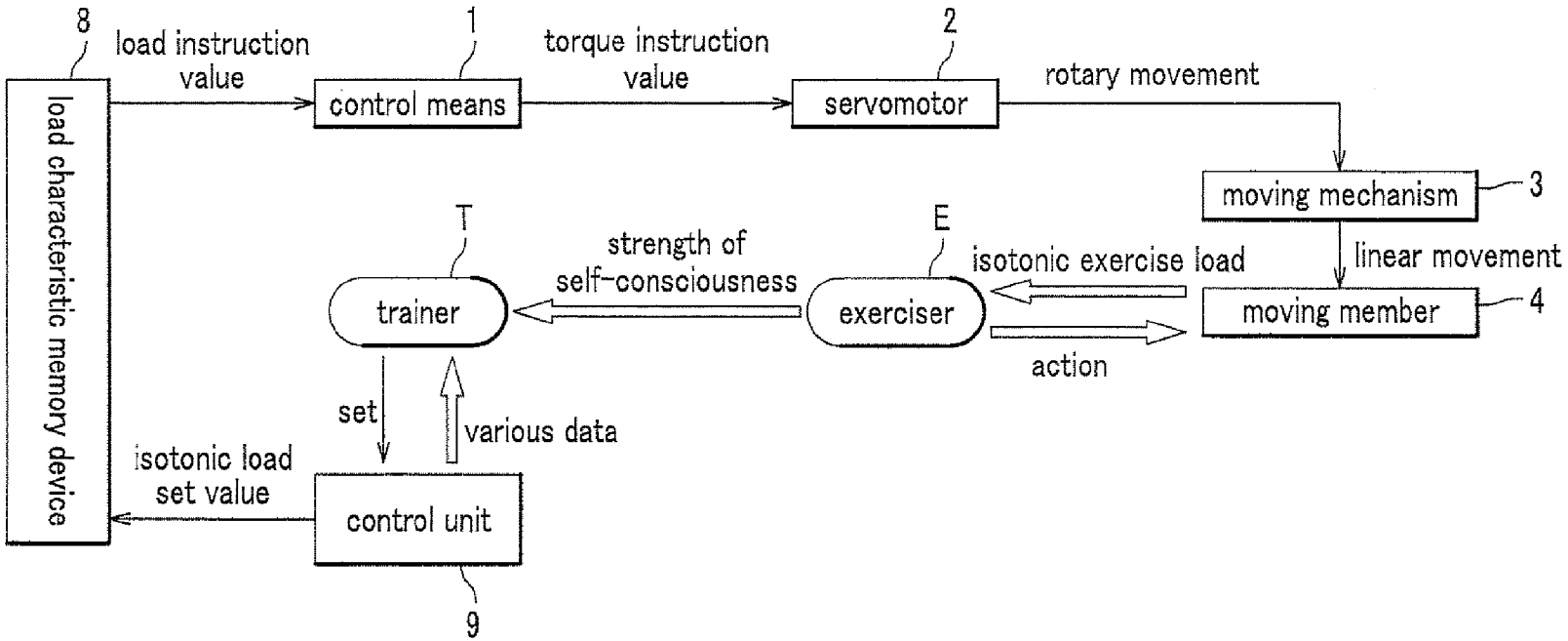
FIG. 4 is a view showing a system configuration of the training device according to a second embodiment of the present invention.

FIG. 4 is a view of system configuration of the training device according to a second embodiment of the present invention. Different from the system configuration in FIG. 2, a system configuration in FIG. 4 does not have the position detection sensor 5 and the velocity calculation means 6, but a control unit 9 for inputting each of set values. That is, a system of this training device is constituted to include the control means 1, the servomotor 2, the movement mechanism 3, the movable member 4, the load characteristic input device 7, the load characteristic memory device 8, and the control unit 9.

Although the system configuration of the training device in FIG. 2 is constituted to input the velocity-load characteristic into the load characteristic input device 7 by the exerciser E, the system configuration of the training device in FIG. 4 is constituted to input various kinds of set values in the control unit 9 according to a strength of self-consciousness of the exerciser E by a trainer (athletic leader) T.

Figure 5:
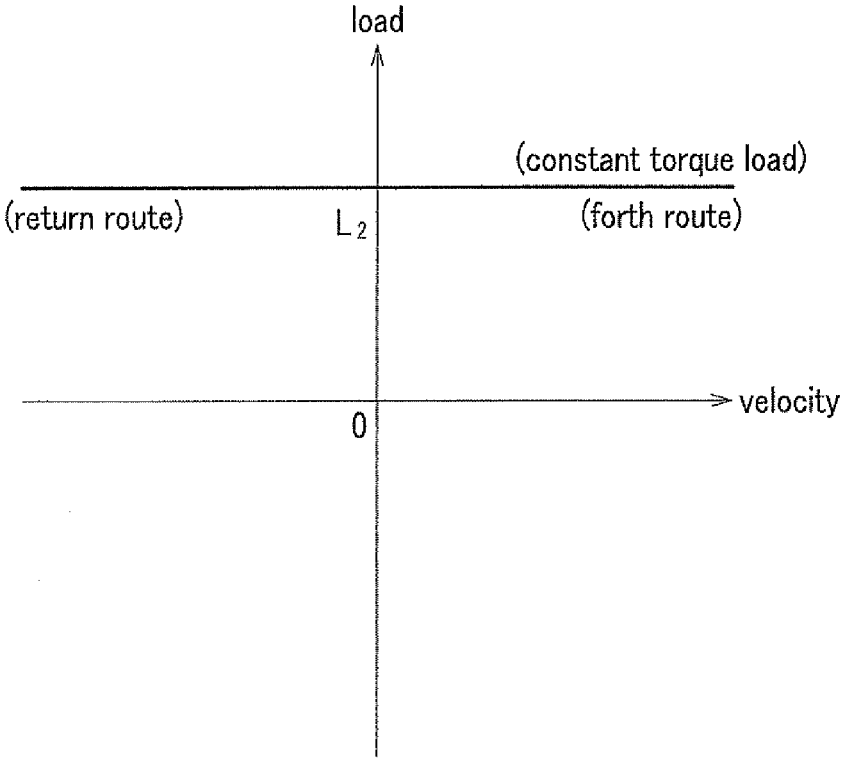
FIG. 5 is a view showing the velocity-load characteristic inputted into the training device in FIG. 4.

FIG. 5 is a view of the velocity-load characteristic inputted into the training device in FIG. 4, in which the horizontal axis represents a velocity and the vertical axis represents a load. The velocity-load characteristic in FIG. 5 shows an isotonic load characteristic (constant torque load characteristic) being a constant load notwithstanding a change of velocity, together with a forth route of first quadrant and a return route of second quadrant. As this isotonic load characteristic is designed to affect the force going toward the exerciser E both in the forth route and in the return route, the load characteristic is represented in the first quadrant and the second quadrant. Such an isotonic load characteristic is designed to obtain by a type of motor instead of the training device based on a plate weight method. Although the isotonic load is designed to set by the control unit 9, the control unit 9 is not an indispensable constitution for setting the isotonic load, but the load characteristic input device 7 can be used for setting the isotonic load even in a constitution of the first embodiment (Referring to FIG. 2).

Next, a system operation of the training device in FIG. 4 will be described with reference to the velocity-load characteristic in FIG. 5. The trainer T is designed to set a value of isotonic load characteristic (a load value of the constant level) shown in FIG. 5 in the control unit 9 based on strength of self-consciousness of the training of the exerciser E and various data concerning the exerciser E shown on the control unit 9

The characteristic of the isotonic load set value shown in FIG. 5 is inputted from the control unit 9 and memorized in the load characteristic memory device 8. The load characteristic memory device 8 is designed to input the load instruction value corresponding to the isotonic load set value in the control means 1. The control means 1 supplies the servomotor 2 with the torque instruction value (driving current) corresponding to the load instruction value. Then, the servomotor 2 is designed to generate the rotary torque equivalent to the torque instruction value and perform the constant torque load control.

In this way, the exerciser E sitting down on the chair 201 can do the muscular workout of the leg against the load L1 applied to the press board 202 by the kinetic energy of the isotonic load converted from a rotary movement having the constant torque to a linear movement of the movable member 4 by the servomotor 2.

In this time, as the load acts toward a direction of the exerciser E in the leg press exercise of the forth route, the concentric exercise is performed. As the load also acts toward a direction of the exerciser E in the return route, the eccentric exercise is performed. That is, the concentric and eccentric exercises can be performed in the training device of the second embodiment shown in FIG. 4.

Third Embodiment

Figure 6:
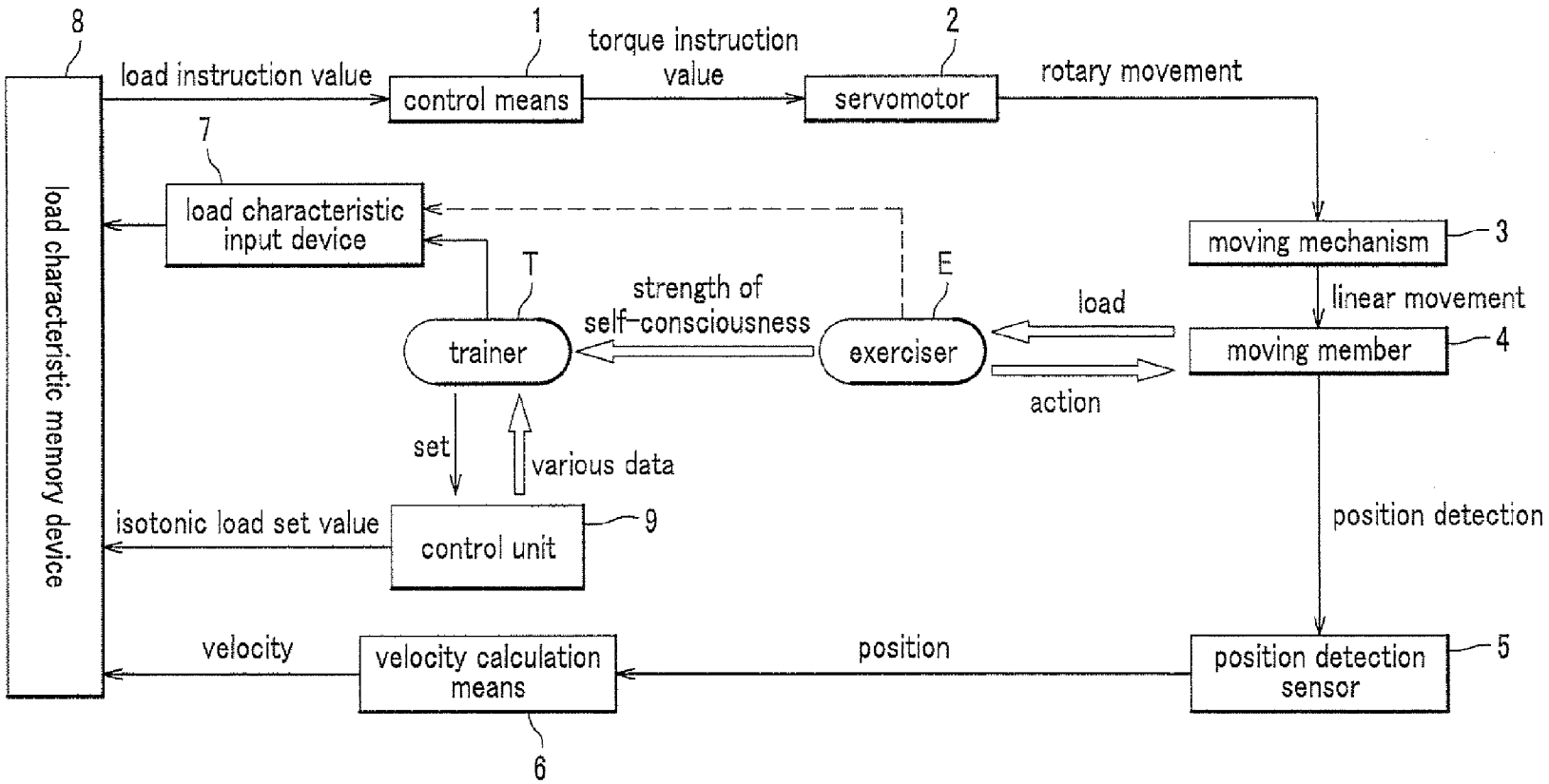
FIG. 6 is a view showing a system configuration of the training device according to a third embodiment of the present invention.

FIG. 6 is a view of system configuration of the training device according to a third embodiment of the present invention.

The system configuration in FIG. 6 is a combination of the system configuration of the first embodiment shown in FIG. 2 and the system configuration of the second embodiment shown in FIG. 4.

A system of this training device is constituted to include the control means 1, the servomotor 2, the movement mechanism 3, the movable member 4, the position detection sensor 5, the velocity calculation means 6, the load characteristic input device 7, the load characteristic memory device 8, and the control unit 9.

Figure 7:
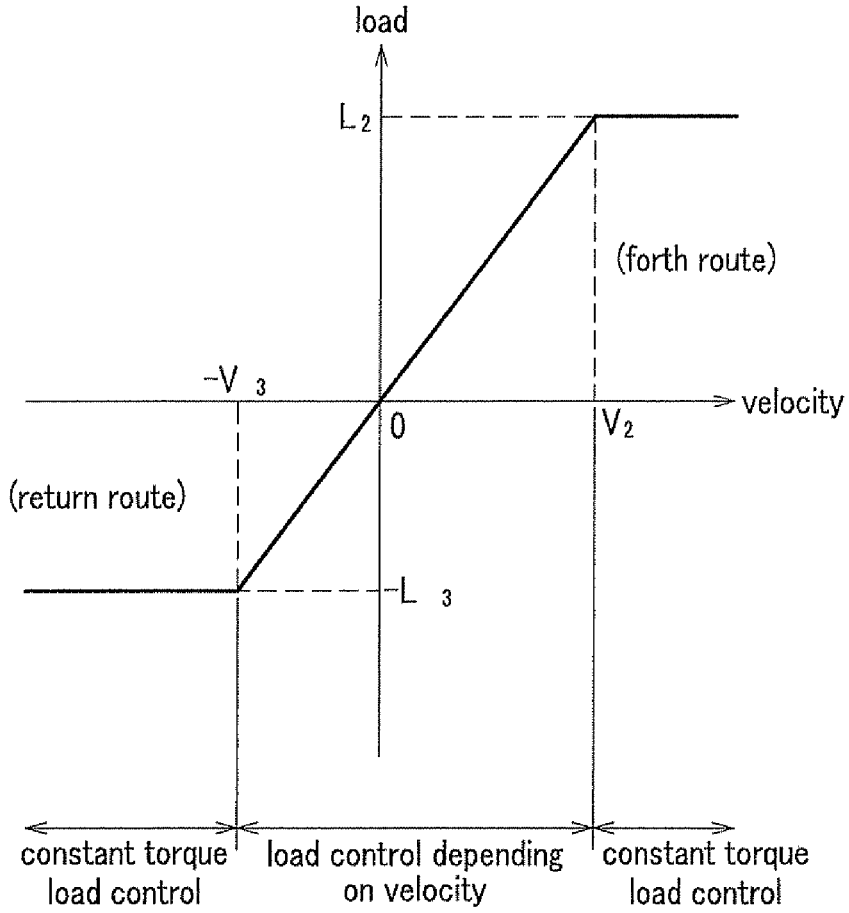
FIG. 7 is a view showing the velocity-load characteristic inputted into the training device in FIG. 6.

FIG. 7 is a view of the velocity-load characteristic inputted in the training device in FIG. 6, and its horizontal axis represents a velocity and the vertical axis represents a load. This velocity-load characteristic shows the load characteristic depending on the velocity changing in a magnitude of load according to the velocity within an area (within an area between −V3 and V2) of the prescribed velocity extending to both sides of a zero point of coordinate axis. It also shows the isotonic load characteristic (constant torque load characteristic) being the prescribed load notwithstanding a change of velocities out of an area of the prescribed velocity.

Avoiding repetitious descriptions, an operation of the training device according to a third embodiment shown in FIG. 6 will be described.

When the exerciser E inputs the velocity-load characteristic shown into FIG. 7 in the load characteristic memory device 7, the velocity-load characteristic is memorized in the load characteristic memory device 8. That is, the velocity-load characteristic is designed to add the load characteristic depending on velocity inputted from the load characteristic input device 7 and the isotonic load characteristic set from the control unit 9.

In FIG. 6, when the exerciser E does the training affecting force against the load generated in the servomotor 2, the position detection sensor 5 detects the moving position of the movable member 4 by the leg press exercise and the lift off exercise. Further, the velocity calculation means 6 calculates the velocity by time differentiating the moving distance of positions detected by the position detection sensor 5 and inputs the velocity in the load characteristic memory device 8.

In this time, while the detected velocity falls within an area between −V3 and V2, the load characteristic memory device 8 inputs a load value corresponding to the velocity inputted from the velocity calculation means 6 as a load instruction value with reference to the load characteristic depending on velocity memorizing in its memory. The control means 1 supplies the servomotor 2 with the torque instruction value (driving current) corresponding to the inputted load instruction value. The servomotor 2 generates the rotary torque equivalent to the torque instruction value and transmits to the movement mechanism 3. The movement mechanism 3 transmits the movable member 4 by a linear movement equivalent to the torque instruction value.

In this way, the exerciser E sitting on the chair 201 can do the muscular workout of legs against the load applied to the press board 202 by the kinetic energy converted from a rotary movement of the servomotor 2 to a linear movement of the movable member 4.

When the movable member 4 moves by such a muscular workout, the position detection sensor 5 detects a moving distance of the movable member 4. Then, the velocity calculation means 6 calculates the velocity by time differentiating the moving distance of the movable member 4 to input this velocity in the load characteristic memory device 8. Furthermore, the load characteristic memory device 8 seeks for a magnitude of the load corresponding to the velocity in accordance with the velocity-load characteristic and rotates the servomotor 2 by inputting a magnitude of the load in the control means 1 as a load instruction value. In this way, the exerciser E does the leg press exercise of the forth route in accordance with the velocity-load characteristic inputted in the load characteristic memory device 8.

When the load corresponding to the velocity is applied from the press board 202 to the leg of the exerciser E on the basis of the velocity-load characteristic shown in the third quadrant of FIG. 7, the exerciser E does the lift off exercise by applying a force corresponding to the load applied to a direction leaving the press board 202.

When the detected velocity is out of an area within the prescribed velocity (−V3 or V2), as the isotonic load characteristic (constant torque load characteristic) is memorized to be inputted from the control unit 9 in the load characteristic memory device 8, the control means 1 rotates the servomotor 2 at a constant torque load control. The rotary movement with a constant torque is transmitted from the movement mechanism 3 to the movable member 4 and converts to a linear movement and applies the load to the exerciser E. In such a way, a concentric-concentric exercise (full concentric exercise) can be done in the training device of the third embodiment shown in FIG. 6.

That is, the system of the training device of the third embodiment shown in FIG. 6 is designed to do the velocity proportional load control within the prescribed velocity area, and the full concentric exercise can be obtained by a hybrid control, that is, a constant torque load control (isotonic load control) in an area being out of the prescribed velocity area.

Safety at the time of reversing to a negative direction can be obtained by such a bidirectional load control, and the safe bidirectional exercise can be obtained by the training device. As the load of exerciser E at the time of normal operation and fatigue condition can be flexibly changed by the above velocity-load characteristic, an appropriate load can be set according to conditions of the exerciser E.

Fourth Embodiment

Figure 8:
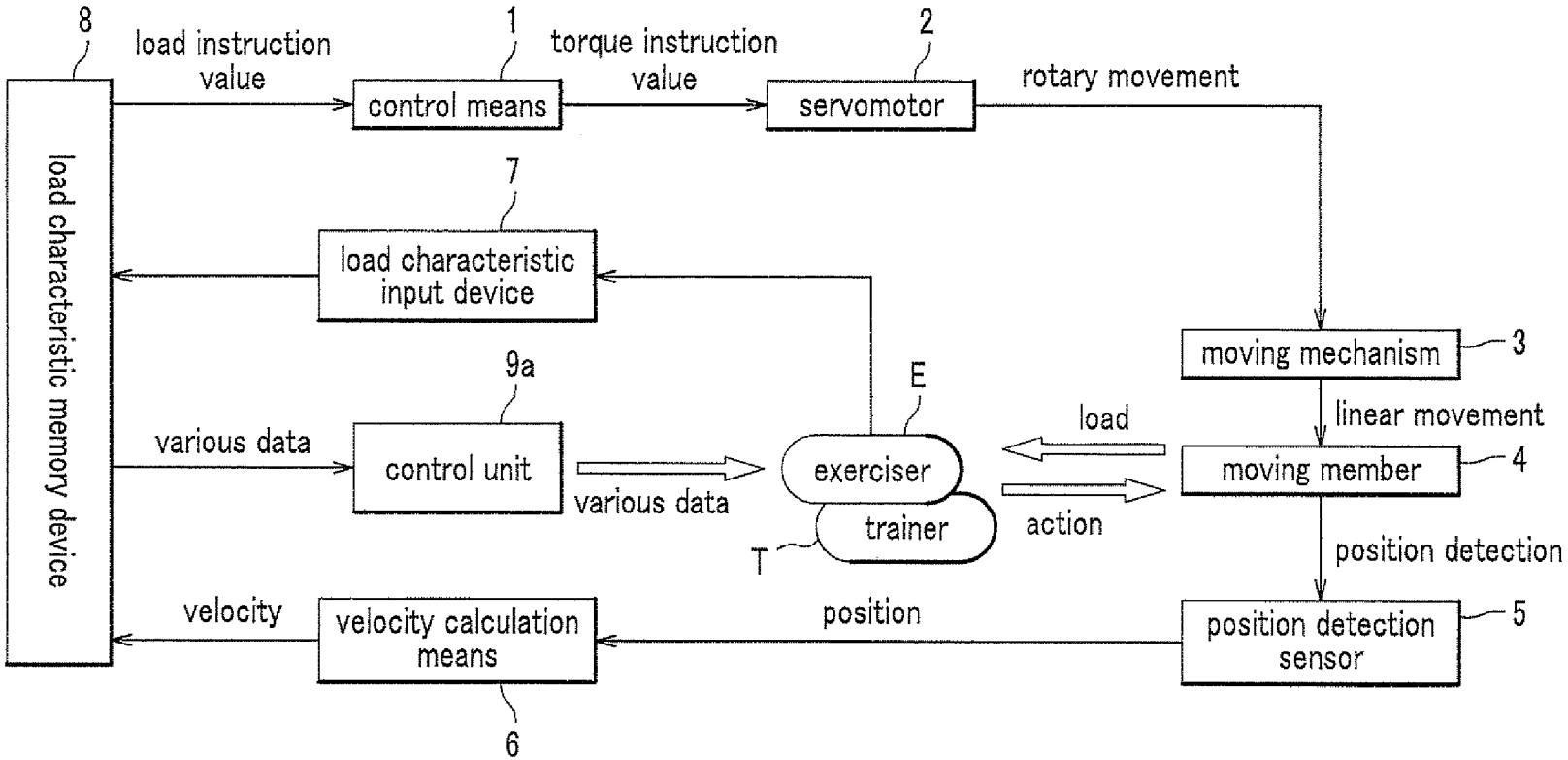
FIG. 8 is a view showing a system configuration of the training device according to a fourth embodiment of the present invention.

FIG. 8 is a view of system configuration of the training device according to a fourth embodiment of the present invention. Although a system configuration in FIG. 8 is approximately the same configuration as the system configuration of the third embodiment in FIG. 6, only a function of the control unit 9*a* is different therefrom. That is, the control unit 9 in the third embodiment of FIG. 6 has a function to set the isotonic load. On the other hand, the control unit 9*a* has a function to change a slope of the velocity-load characteristic. Although the control unit is designated as a referential numerical 9 in FIG. 6, the control unit is designated as a referential numerical 9*a* in FIG. 8. As the other configuration is the same as one in FIG. 6, a repetition of descriptions in configuration will be omitted. The case of forth route between the forth and return routes will be, hereinafter, described as a typical example.

Figure 9:
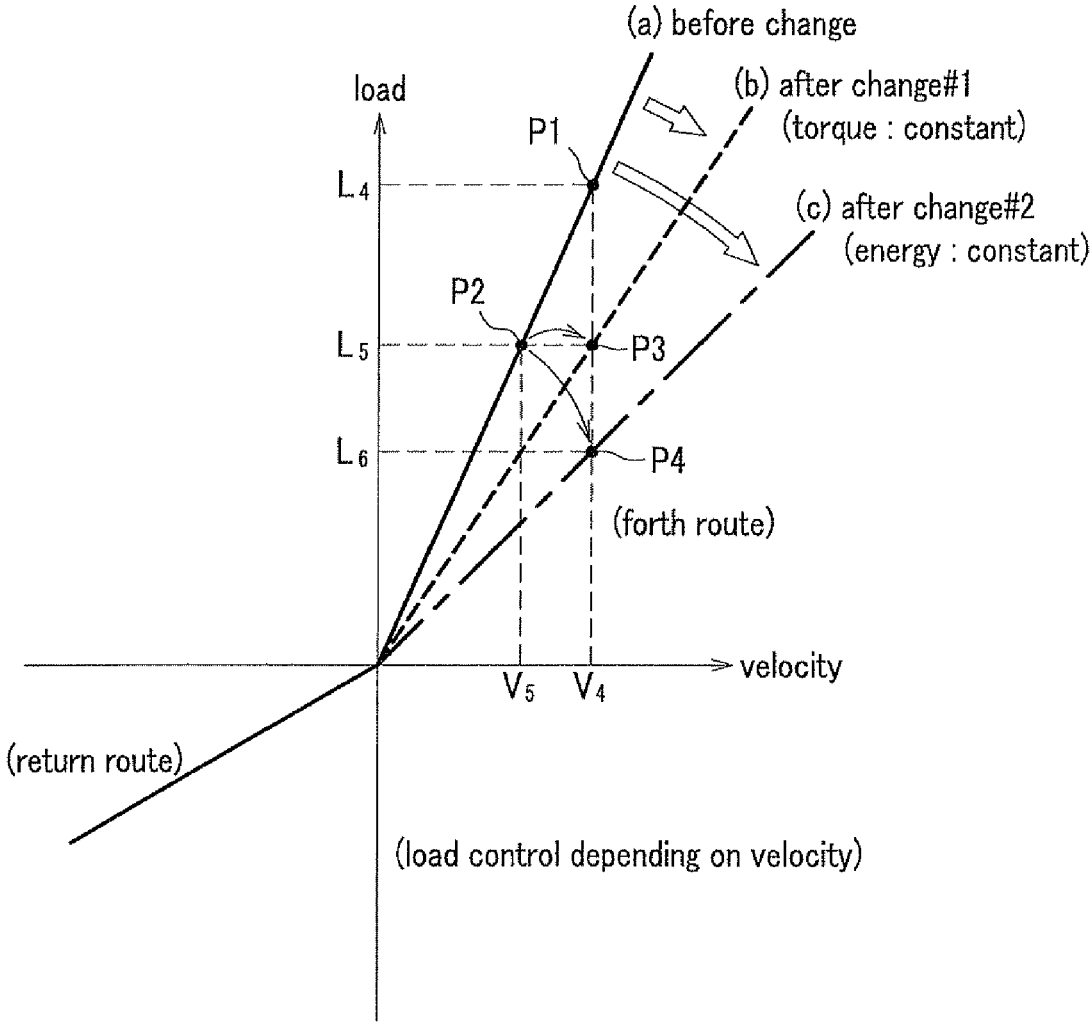
FIG. 9 is a view showing the velocity-load characteristic inputted into the training device in FIG. 8.

FIG. 9 is a view of the velocity-load characteristic inputted into the training device in FIG. 8, the horizontal axis is a velocity and the vertical axis is a load. At first, the load characteristic of "a) before change" is given as a velocity-load characteristic. Herein, a standard velocity V4 set up ideal moving velocity for an exerciser E and a line passing through a point P1 (and zero point) corresponding to an ideal load L4 are given as a load characteristic of "a) before change".

However, the exerciser E is not limited to exercise at the standard velocity V4, but the exerciser E used to exercise at a velocity V5, in reality, caused by fatigue, etc. In the load characteristic of "a) before change", the load is L5 at a velocity V5, and its coordinate is P2. In this case, although the moving velocity of the exerciser E can be improved by reducing a slope of the velocity-load characteristic, a way of thinking as for a slope is, for example, the following two kinds of methods.

One method is a method for reducing a slope of the velocity-load characteristic to maintain constantly a torque of the servomotor 2. Specifically, as shown in the load characteristic of "b) after change #1" in FIG. 9, the load characteristic at the velocity V4 may be changed to a line passing through a point P3 (and a zero point) being the load L5 at the velocity V4.

Another method is a method for reducing a slope of the velocity-load characteristic to maintain constantly a rate of power (energy). More specifically, as shown in the load characteristic of "c) after change #2" in FIG. 9, the load characteristic may be changed in a line passing through a point P4 (and zero point) being the load L6 at the velocity V4. In this case, as a value of velocity multiplied by the load, that is, a rate of power of the exerciser E is designated to be constant, a slope of the line of the load characteristic of "c) after change #2" may be designated to be a constant in values of the rate of power (V5 by L5) concerning a point P2 and the rate of power (V4 by L6) concerning a point P4.

In the training device of the fourth embodiment shown in FIG. 8, the velocity-load characteristic (a) is memorized in the load characteristic memory device 8 by inputting the velocity-load characteristic (a) "(a) before change)" (Referring to FIG. 9) into the load characteristic input device 7. At the time of exercise, the position detection sensor 5 detects a position of the movable member 4, calculates the velocity by time differentiating the moving distance of position by the velocity calculation means 6, and inputs the velocity data into the load characteristic memory device 8. Thereafter, the control means 1 controls the rotary torque of the servomotor 2 in accordance with the torque instruction value corresponding to the velocity-load characteristic (a) memorized in the load characteristic memory device 8 with use of the velocity data, and applies the load to the exerciser E by converting a rotary torque into a linear driving power by the movement mechanism 3 and the movable member 4. In this way, the exerciser E can do the full concentric exercise corresponding to the load characteristic to the velocity by a repetition of the velocity calculation and the load application.

Furthermore, the control means 11 can change automatically the velocity-load characteristic into "b) after change" (referring to FIG. 9) or "c) after change" (referring to FIG. 9), corresponding to the reduction of the moving velocity of the exerciser E or the like. In addition, it is preferable to change little by little, but it may change rather quickly.

In this way, the control means 1 is designed to control the rotary torque of the servomotor 2 in accordance with the torque instruction value corresponding to the load characteristic of "b) after change #1" (Referring to FIG. 9) or "c) after change #2" (Referring to FIG. 9) memorized in the load characteristic memory device 8, and apply the load to the exerciser E by converting a rotary torque into a linear driving power by the movement mechanism 3 and the movable member 4. Then, the concentric exercise can be obtained to the exerciser E.

In this way, in the training device of the fourth embodiment shown in FIG. 8, an appropriate full concentric exercise can be obtained self-controlling the load to be constant in a rate of power of the exerciser E or a torque of the servomotor 2. In case where the full concentric exercise can be obtained at a constant power or torque, an emergency function such as warning an alarm or an urgent stop caused by arrhythmia detection may be provided in the training device. That is, a problem of shortage of experienced workers can be solved by providing an appropriate automatic load control or an urgent stop function according to physical conditions of the exerciser E therein. In addition, the velocity-load characteristic is not limited to a linear characteristic as shown in FIG. 9, but may be a non-linear characteristic as described in the first embodiment.

(A Study of the Full Concentric Exercise)

Figure 10:
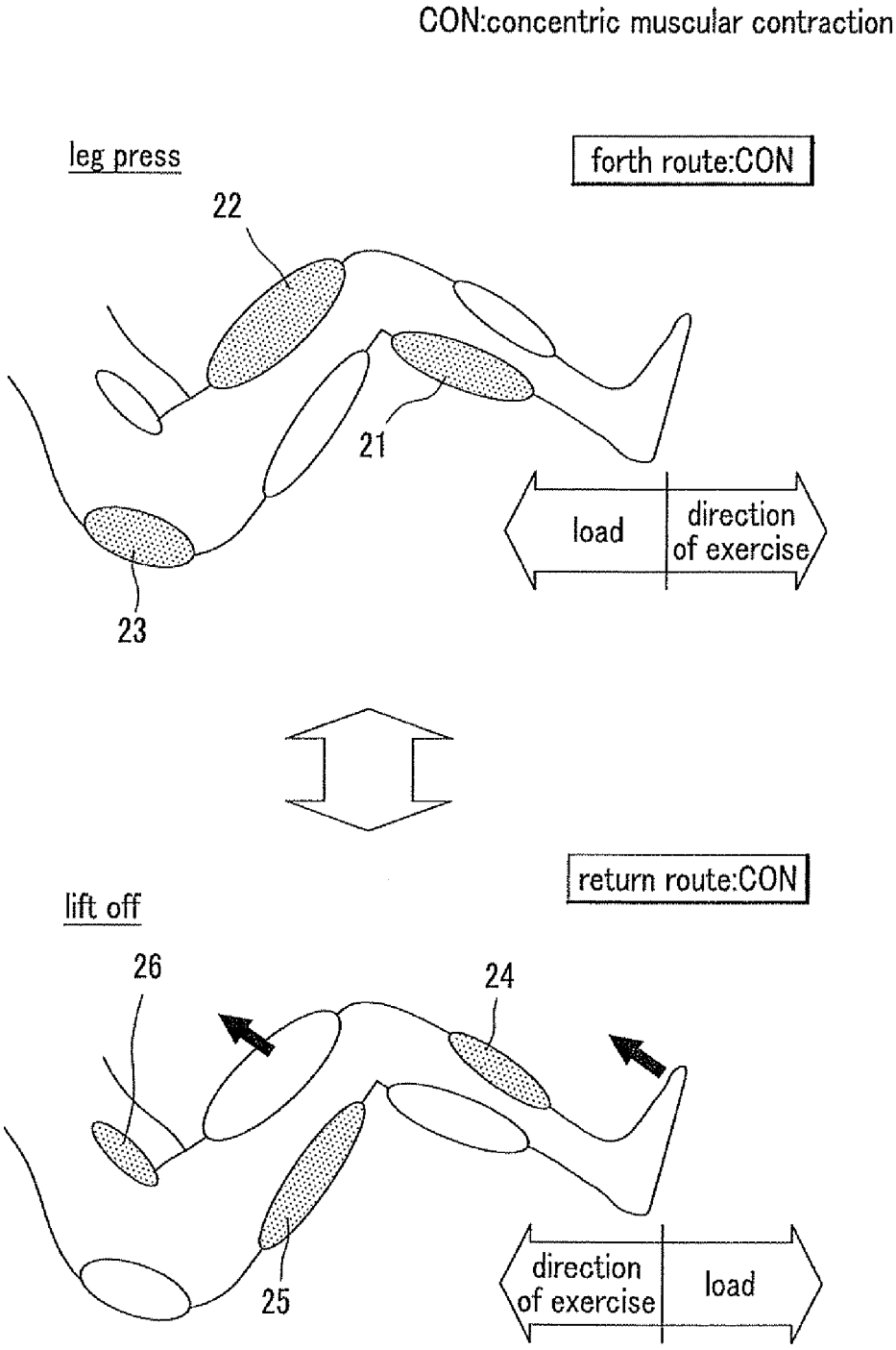
FIG. 10 is a conceptual view showing a state of muscular workout of legs in a full concentric exercise.

In a state in which an effective full concentric exercise can be obtained by the training device in the above embodiment, it will be studied from the clinical point of view. FIG. 10 is a concept view showing a state of muscular workout of leg in the full concentric exercise, FIG. 10 is a leg press exercise of the forth route and a lift off exercise of the return route.

In the forth route shown in FIG. 10, the load directs toward a direction for pushing tips of legs as shown by an arrow, and the leg press exercise is done in a direction for stretching legs against the load. In this time, the muscular workout of triceps surae 21, quadriceps 22, and gluteus maximus muscle 23 are done.

In the return route shown in FIG. 10, the load directs toward a direction for stretching legs as shown by an arrow, and the lift off exercise is done in a direction for contracting legs against the load. In this time, the muscular workout of tibialis anterior muscle 24, hamstring 25, and Iliopsoas muscle 26 are done.

As the full concentric eccentric exercise by such leg press exercise and lift off exercise is designed to reduce damages to each muscle, physically gentle exercises can be done for aged person. Furthermore, a magnitude of loads in forth and return routes and a number of exercises can be appropriately set by quantitatively understanding a rate of muscular strength in the leg press exercise and the lift off exercise.

The training device of this embodiment is designed to do appropriately an innovative and useful exercise mode for aged person by doing a reactive movement of the leg press exercise, that is, the lift off exercise. Furthermore, the prevention of stumbling and improvement of walking capacity can be effectively obtained by strengthening the tibialis anterior muscle 24 with use of the muscular workout. Still further, the high knee movements and improvement of walking capacity can be effectively obtained by strengthening the Iliopsoas muscle 26.

When you do muscular workout by the training device according to the present invention, a group of muscles besides the above muscle can be strengthened at the same time. That is, muscular workout in various kinds of exercise forms can be done by one of training devices. Then, the exercise can be effectively done in a short time, the capital investment of the device can be economized in training gyms or the like, and a space for mounting the device can be made small. In the training device of this embodiment, as agonist muscles and antagonist muscles are alternatively contracted during one cycle of the exercise, fatigues (lactic acid) can be dispersed. The load resistance in forth and return routes of bending and stretching exercises can be independently controlled. The physically gentle exercise can be done by the full concentric exercise without physical burdens such as muscular pain. The training device of this embodiment can provide an aerobic exercise, measurement against metabolic syndrome and the strengthening of pulmonary function can be effectively obtained.

The training device of this embodiment can be applied not only to a leg press machine, but also to an overall training device, as exercised by load, such as a chest press machine, an arm curl machine. More specifically, it may be, for example, the training device, which is constituted by a chair of exercisers doing muscular workout, a bar gripped by a hand when the exerciser does the muscular workout, and a mechanism for converting a rotary movement of an electric motor into a linear movement in order to bend and stretch arms for an exerciser sitting on the chair. With a combination of a bar gripped by a hand and a press board pushing with tips of legs, it may be a training device using a movement mechanism converting a rotary movement of an electric motor into a linear movement in order to bend and stretch legs and arms of the exerciser sitting on the chair. In this case, a movement mechanism to be reverse directions each other between directions of bending and stretching exercise of legs and arms can be applied when the exerciser does the muscular workout.

Although the training device in FIG. 1 is constituted so that the press board is fixed and the chair is movable, it may be constituted so that the chair is fixed and the press board is movable. Although the slope is designed to make small in case where a line showing the velocity-load characteristic in FIG. 9 is changed, the slope may be designed to make large, supposing the idleness or negligence of exercisers. Furthermore, a specific constitution can be appropriately changed without departing from a scope of the present invention.

The invention claimed is:

1. A training device doing muscular workout to apply load caused by a rotary torque of an electric motor to an exerciser comprising:

a detection means seeking for a velocity or acceleration of an exercise in the muscular workout;

a load characteristic input device for inputting a velocity-load characteristic being a load characteristic to the velocity or an acceleration-load characteristic being a load characteristic to the acceleration;

a load characteristic memory device memorizing the velocity-load characteristic or the acceleration-load characteristic; and a control means calculating a torque instruction value as a driving current in accordance with the velocity-load characteristic or the acceleration-load characteristic memorized in the load characteristic memory device and controlling a rotary torque of the electric motor in accordance with the torque instruction value, wherein the velocity-load characteristic is a load characteristic passing through a zero point and facing a reverse direction between a positive value and a negative value in velocity in case where the load characteristics are shown as a characteristic line on a coordinate with a velocity and a load designated as each axis, respectively, wherein the velocity-load characteristic changes a slope of the load at forth and return routes to obtain a suitable velocity-load characteristic for each exerciser, and at first the velocity-load characteristic is given such that the velocity-load characteristic passes through a point that denotes an ideal load at a standard velocity, which is ideal moving velocity for the exerciser, and wherein when an exercise velocity, at which the exerciser used to exercise, less than the standard velocity, the control means changes the velocity-load characteristic so that the velocity-load characteristic passes through a point that denotes an exercise load, which is equal to a load at the exercise velocity on the velocity-load characteristic before changing, at the standard velocity, or passes through a point that denotes a predetermined load at the standard velocity wherein the product of the standard velocity and the predetermined load is equal to the product of the exercise velocity and the exercise load.

2. The training device according to claim 1 wherein the device comprises an energy recovery means for preventing overvoltage generating at the time of reverse rotation of the electric motor.

3. The training device according to claim 2 wherein the energy recovery means is a generator obtained by the electric motor.

4. The training device according to claim 3 wherein the device comprises an electric charger accumulating electric energy generated by the generator.

5. The training device according to claim 4 wherein the device comprises a display operated by electric energy accumulated in the electric charger.

6. The training device according to claim 1 wherein the velocity-load characteristic is a load characteristic in which load is proportional to a n-th power of a magnitude of velocity in case where n is positive number, and the control means controls the rotary torque of the electric motor in accordance with the load characteristic.

7. The training device according to claim 1 wherein the velocity-load characteristic is a load characteristic in which load is proportional to a velocity within a prescribed area of a magnitude of velocity locating around a zero point of the coordinate axis and the load is constant notwithstanding a change of velocity beyond the prescribed range of a magnitude of velocity, and the control means controls the rotary torque of the electric motor in accordance with the load characteristic.

8. The training device according to claim 6 wherein the velocity-load characteristic is constituted to change such that either a power represented by a product of load and velocity or the rotary torque of the electric motor is constant when the velocity changes, and the control means is constituted to control the rotary torque of the electric motor in accordance with the load characteristic.

9. The training device according to claim 1
wherein
the velocity-load characteristic is a load characteristic in which a line passing through points corresponding to standard velocity designated as a target of ideal moving velocity and ideal load is shown, and
the control means controls the rotary torque of the electric motor in accordance with the load characteristic.

10. The training device according to claim 1
wherein
the device comprises
a chair of exercisers doing the muscular workout,
a press board for fixing tips of legs of the exerciser and pushing by tips of legs when the exerciser does the muscular workout, and
a movement mechanism converting the rotary movement of the electric motor into a linear movement in order to bend and stretch the legs of the exercisers sitting down on the chair.

11. The training device according to claim 1
wherein
the device comprises
a chair of exercisers doing the muscular workout,
a bar gripped by a hand when the exercisers do the muscular workout, and
a movement mechanism converting the rotary movement to the linear movement in order to bend and stretch the legs of the exercisers sitting down on the chair.

12. The training device according to claim 1
wherein
the device comprises
a chair of exercisers doing the muscular workout,
a press board for fixing the tips of legs of exercisers and pushing with the tips of legs when the exercisers do the muscular workout,
a bar gripped by a hand when the exercisers do the muscular workout, and
a movement mechanism converting the rotary movement of the electric motor to the linear movement in order to bend and stretch the legs and arms of the exercisers sitting down on the chair.

13. The training device according to claim 1
wherein
the movement mechanism is a mechanism reversing directions of bending and stretching exercise of legs and arms each other when the exerciser do the muscular workout.

14. A control method of a training device doing muscular workout to apply load caused by a rotary torque of an electric motor to an exerciser in accordance with a velocity-load characteristic being a load characteristic to a velocity or an acceleration-load characteristic being a load characteristic to an acceleration,
wherein
at first the velocity-load characteristic is given such that the velocity-load characteristic passes through a point that denotes an ideal load at a standard velocity, which is ideal moving velocity for the exerciser,
the control method comprising:
a first step seeking for a velocity or an acceleration of exercise in the muscular workout,
a second step calculating a torque instruction value as a driving current by a control means in accordance with the velocity-load characteristic or the acceleration-load characteristic with the velocity or the acceleration of exercise sought for by the first step and controlling the rotary torque of the electric motor in accordance with the torque instruction value, and
if an exercise velocity, at which the exerciser used to exercise, less than the standard velocity,
then a third step changes the velocity-load characteristic so that the velocity-load characteristic
passes through a point that denotes an exercise load, which is equal to a load at the exercise velocity on the velocity-load characteristic before changing, at the standard velocity, or
passes through a point that denotes a predetermined load at the standard velocity wherein the product of the standard velocity and the predetermined load is equal to the product of the exercise velocity and the exercise load.

* * * * *